US011384703B2

(12) United States Patent
Urakawa

(10) Patent No.: US 11,384,703 B2
(45) Date of Patent: Jul. 12, 2022

(54) CONTROLLER FOR AIR-FUEL RATIO SENSOR, AND PROGRAM FOR DETECTING FAILURE OF AIR-FUEL RATIO SENSOR

(71) Applicant: DENSO WAVE INCORPORATED, Aichi-pref. (JP)

(72) Inventor: Takayuki Urakawa, Chita-gun (JP)

(73) Assignee: DENSO WAVE INCORPORATED, Aichi-pref. (JP)

( * ) Notice: Subject to any disclaimer, the term of this patent is extended or adjusted under 35 U.S.C. 154(b) by 379 days.

(21) Appl. No.: 16/541,295

(22) Filed: Aug. 15, 2019

(65) Prior Publication Data

US 2020/0088121 A1 Mar. 19, 2020

(30) Foreign Application Priority Data

Sep. 18, 2018 (JP) ..... JP2018-173674

(51) Int. Cl.
*F02D 41/14* (2006.01)

(52) U.S. Cl.
CPC ..... *F02D 41/1495* (2013.01); *F02D 41/1454* (2013.01); *F02D 41/1494* (2013.01); *F02D 41/1496* (2013.01)

(58) Field of Classification Search
CPC ... F02D 41/1454; F02D 41/1494–1496; F02D 2041/2027
See application file for complete search history.

(56) References Cited

U.S. PATENT DOCUMENTS

2004/0025856 A1 2/2004 Iida et al.

FOREIGN PATENT DOCUMENTS

JP 3855877 B2 12/2006
JP 2017145762 A * 8/2017

OTHER PUBLICATIONS

JP 2017-145762, machine translation. (Year: 2017).*

* cited by examiner

*Primary Examiner* — Hung Q Nguyen
*Assistant Examiner* — Mark L. Greene
(74) *Attorney, Agent, or Firm* — Harness, Dickey & Pierce, P.L.C.

(57) ABSTRACT

A controller is used for an air-fuel ratio sensor. The air-fuel sensor includes a detection element that detects an oxygen concentration, and a PWM-controlled heater that receives a PWM signal for temperature control of the detection element. The controller includes a resistance detection circuit configured to detect a resistance of the detection element, and a processor. The processor is programmed to generate the PWM signal for the heater based on the detected resistance such that the resistance of the detection element is kept at a predetermined target resistance, and determine whether a failure has occurred in the air-fuel ratio sensor based on a manner of time-series increase in duty cycle of the PWM signal.

7 Claims, 10 Drawing Sheets

CONTROLLER FOR AIR-FUEL RATIO SENSOR, AND PROGRAM FOR DETECTING FAILURE OF AIR-FUEL RATIO SENSOR

CROSS REFERENCE TO RELATED APPLICATION

The present application claims the benefit of priority from Japanese Patent Application No. 2018-173674 filed on Sep. 18, 2018. The entire disclosure of the above application is incorporated herein by reference.

TECHNICAL FIELD

The present disclosure relates to a controller for controlling an air-fuel ratio sensor, and a program for detecting a failure of the air-fuel ratio sensor.

BACKGROUND

For example, in a combustion device such as a gas water heater, an air-fuel ratio sensor for detecting an oxygen concentration in an exhaust gas is provided in an exhaust path, and a combustion control is performed by detecting the air-fuel ratio from the detected oxygen concentration.

SUMMARY

According to at least one embodiment of the present disclosure, a controller is used for an air-fuel ratio sensor. The air-fuel sensor includes a detection element that detects an oxygen concentration, and a PWM-controlled heater that receives a PWM signal for temperature control of the detection element. The controller includes a resistance detection circuit configured to detect a resistance of the detection element, and a processor. The processor is programmed to generate the PWM signal for the heater based on the detected resistance such that the resistance of the detection element is kept at a predetermined target resistance, and determine whether a failure has occurred in the air-fuel ratio sensor based on a manner of time-series increase in duty cycle of the PWM signal.

DETAILED DESCRIPTION

Figure 1:
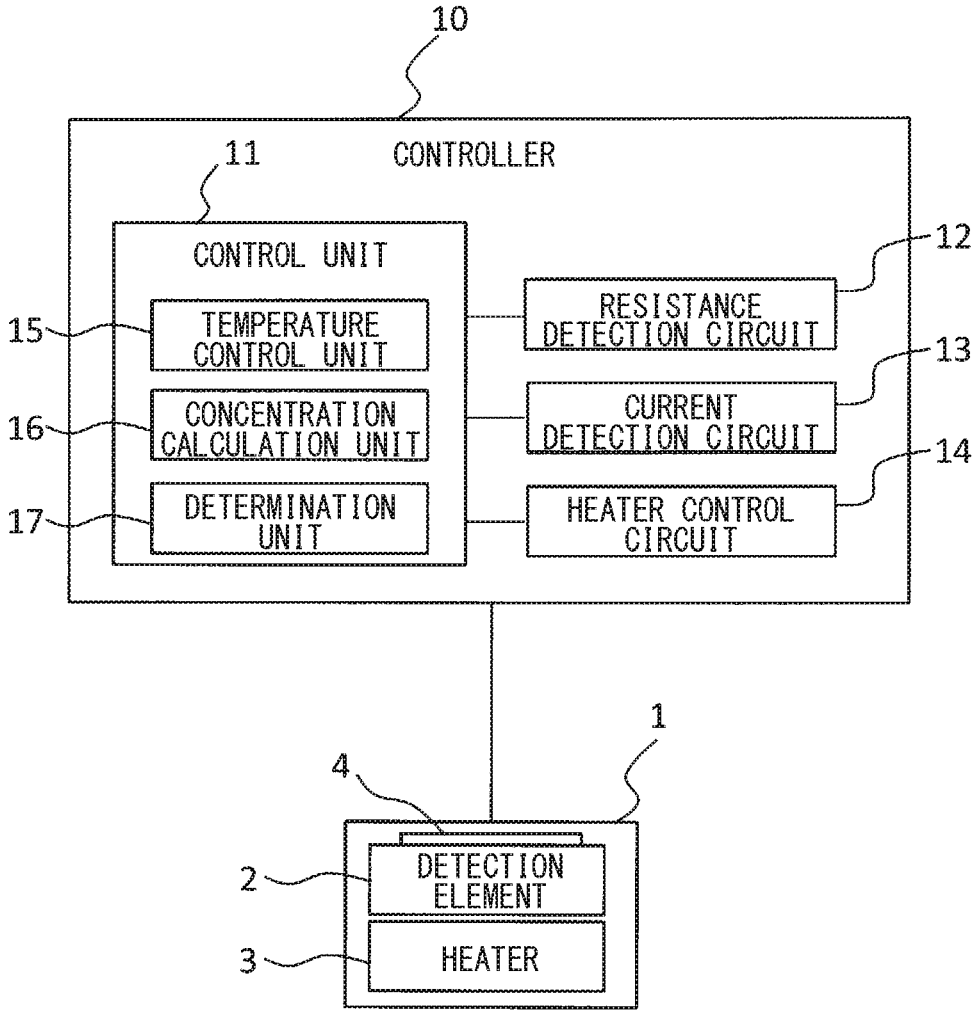
FIG. 1 is a diagram schematically showing a configuration of a controller according to at least one embodiment.

Hereinafter, a plurality of embodiments will be described with reference to the drawings. In each embodiment, substantially common parts are denoted by the same reference numerals.

First Embodiment

Hereinafter, a first embodiment will be described with reference to FIGS. 1 to 7.

As shown in FIG. 1, an air-fuel ratio sensor 1 includes a detection element 2 and a heater 3, and as is well known, the air-fuel ratio sensor 1 is configured to output a current corresponding to an oxygen concentration in an exhaust gas. The air-fuel ratio sensor 1 is strictly called an oxygen concentration sensor, but is referred to herein as an air-fuel ratio sensor 1 as used to determine an air-to-fuel ratio.

The detection element 2 is formed of a solid electrolyte element containing zirconia, and is accommodated in a main body (not shown) through a fitting portion 4. The heater 3 is controlled by a PWM control, and is provided in the vicinity of the detection element 2, and adjusts a temperature of the detection element 2 so that a resistance of the detection element 2 becomes an optimum value for detecting the oxygen concentration.

The controller 10 to which the air-fuel ratio sensor 1 configured as described above is connected includes a control unit 11 necessary for controlling the air-fuel ratio sensor 1, a resistance detection circuit 12 corresponding to a resistance detection unit for detecting a resistance of the detection element 2, a current detection circuit 13 for detecting a current output from the air-fuel ratio sensor 1, that is, a current output in accordance with the oxygen concentration, and a heater control circuit 14 corresponding to a heater control unit for outputting a PWM signal for PWM-controlling the heater 3 as a voltage signal. In the present embodiment, it is assumed that the controller 10 is provided as a detection kit together with the air-fuel ratio sensor 1, and although not shown, the controller 10 is also provided with an output circuit or the like for outputting the detected oxygen concentration or air-fuel ratio of the air-fuel mixture to an external device.

The control unit 11 is configured by a microcontroller, and includes a CPU, a ROM and a RAM. The control unit 11 includes a temperature control unit 15 for generating a PWM signal for controlling the heater 3, a concentration calculation unit 16 for calculating the oxygen concentration based on a current value output from the air-fuel ratio sensor 1, and a determination unit 17 for determining whether or not a failure has occurred in the air-fuel ratio sensor 1 based on a change in the duty cycle of the PWM signal, which will be described later in detail.

The temperature control unit 15, the concentration calculation unit 16, and the determination unit 17 are realized by software in the present embodiment. For that reason, the controller 10 according to the present embodiment can determine whether or not a failure has occurred in the air-fuel ratio sensor 1 by only a circuit configuration required for the air-fuel ratio sensor 1. In other words, the controller 10 functions as a device for controlling the air-fuel ratio sensor 1, and also functions as a device for detecting a failure occurring in the air-fuel ratio sensor 1.

Next, the operation of the configuration described above will be described.

As described above, when the oxygen concentration is detected with the use of the air-fuel ratio sensor 1, it is required that a resistance of the detection element 2 is optimally activated. At that time, since it is assumed that the general combustion device is operated continuously, it is desirable that the air-fuel ratio sensor 1 itself is maintained in an optimum state for detection even when a failure is determined. On the other hand, if a detection device for detecting a failure is provided separately from the controller 10, an installation space or an attachment structure is required, which is not desirable.

In addition, if not only the occurrence of a failure in the air-fuel ratio sensor 1 can be detected but also the type of the failure can be identified, it is considered that a malfunction portion can be identified at an early stage, and measures such as repair or replacement are easily taken.

Therefore, in the present embodiment, a failure occurring in the air-fuel ratio sensor 1 can be detected by the controller 10 alone of the air-fuel ratio sensor 1 while maintaining an optimum state for the detection of the oxygen concentration as described below.

First, since the failures assumed to occur in the air-fuel ratio sensor 1 can be classified as follows, the details of each of the failures will be described individually.

Cracks in the detection element 2.

Fitting failure of the detection element 2.

Malfunction of the heater 3.

Aging deterioration of the detection element 2.

<Crack of Detection Element 2>

Since the detection element 2 is a solid electrolyte element as described above and is used at a relatively high temperature, cracks or chaps may occur when water generated during combustion is adhered to the detection element 2. If the detection element 2 is completely damaged, the resistance becomes infinite, and thus the detection element 2 can be detected as an abnormality separately. Therefore, a condition in which a part of the detection element 2 is damaged is referred to as a crack.

When a crack occurs, the resistance of the detection element 2 greatly increases as compared with the resistance at the time of normal operation in which no crack occurs. Hereinafter, the resistance at the time of normal operation will be referred to as a target resistance for convenience. When the resistance of the detection element 2 increases above the target resistance, there is a need to bring the resistance of the detection element 2 closer to the target resistance, that is, to heat the detection element 2 and lower the resistance in order to maintain the optimum state for detection.

Figure 2:
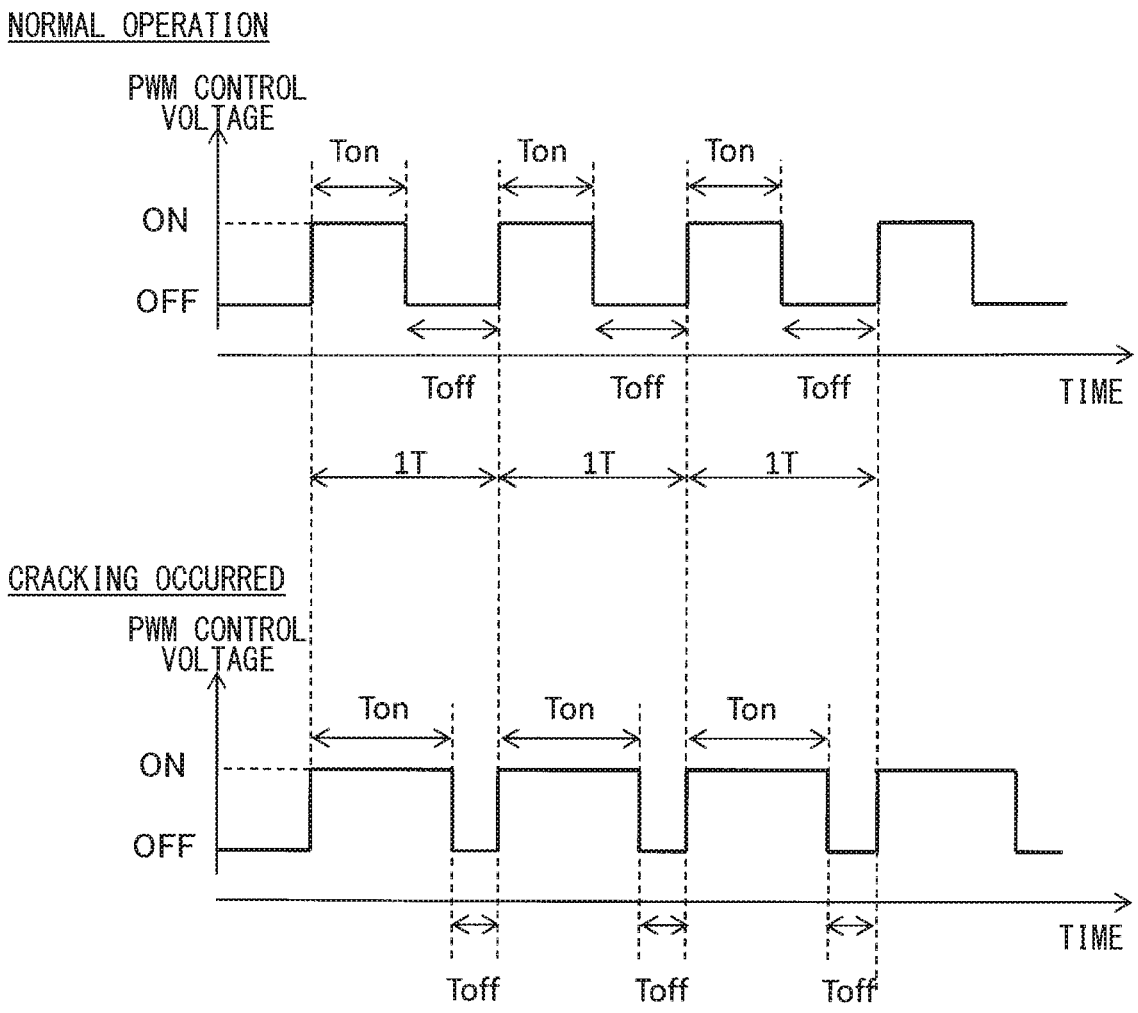
FIG. 2 is a diagram schematically showing a PWM signal when a failure of cracking occurs.

For that reason, when a crack occurs in the detection element 2, the temperature of the heater 3 needs to be raised, and therefore, as shown in FIG. 2, a ratio of an ON period (Ton) in one cycle (1T) of the PWM signal at the time of crack generation becomes larger than a ratio of the ON period (Ton) of the PWM signal at the time of normal operation.

For that reason, when the duty cycle of the PWM signal is greatly increased in a short period of time, for example, with respect to the immediately preceding duty cycle, it is considered that a failure of crack generation occurs in the detection element 2. In that case, in order to distinguish the failure of cracking from the fitting failure, a configuration may be employed in which it is determined that the cracking failure has occurred when a change has not been observed in a predetermined determination period after the duty cycle is increased.

<Fitting Failure of Detection Element 2>

As described above, the detection element 2 is fixed to the sensor body through the fitting portion 4. The fitting portion 4 is a physical connection member, and when the fitting portion 4 is damaged, it is considered that a failure such as a so-called poor contact occurs in which the contact state changes due to vibration or the like. When such a fitting failure occurs, the resistance of the detection element 2 changes in accordance with the contact state, and a state is observed in which the resistance becomes the same value as the resistance at the time of normal operation or increases more than the resistance at the time of normal operation. In other words, when the fitting failure occurs, it is considered that the resistance of the detection element 2 changes in a relatively short period of time when observed over time.

Figure 3:
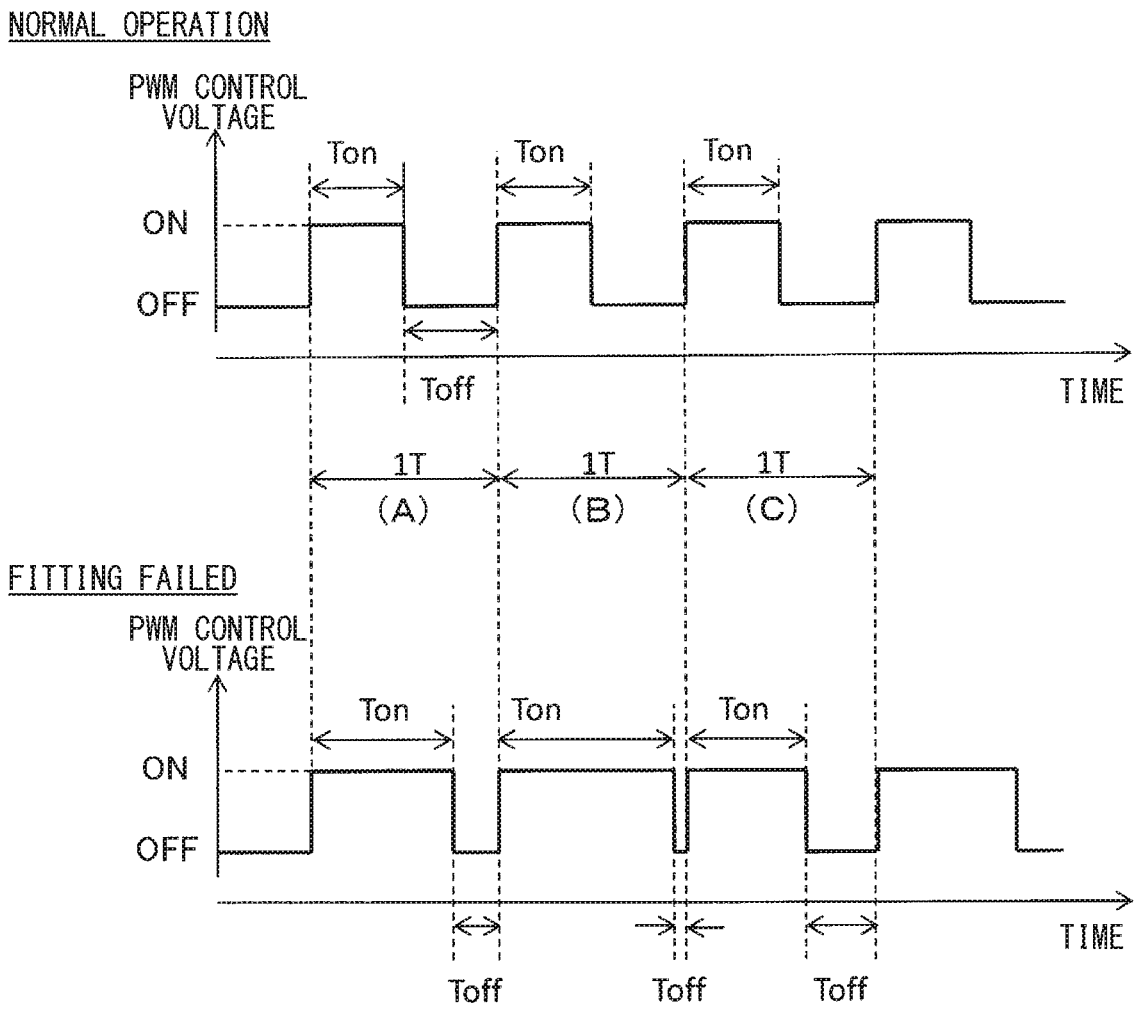
FIG. 3 is a diagram schematically showing a PWM signal when a fitting failure occurs.

For that reason, when a fitting failure occurs, since the temperature of the heater 3 needs to be adjusted to a different temperature in a short period of time, as shown in FIG. 3, a state is observed in which the ratio of the ON period (Ton) of the PWM signal in one cycle (1T) at the time of the fitting failure deviates from the ON period (Ton) of the PWM signal at the time of the normal operation, and the deviation changes in a relatively short period. For that reason, when the duty cycle of the PWM signal is greatly deviated from the duty cycle at the time of normal operation, and a manner of increase in which the deviation amount changes in a relatively short period of time is observed, it is considered that the fitting failure occurs.

<Malfunction of Heater 3>

When the heater 3 malfunctions, even if the temperature of the heater 3 is attempted to be increased, the temperature of the heater 3 is hardly raised, and even if the detection element 2 is controlled by the same PWM signal as that in the normal operation, it is considered that the temperature of the detection element 2 does not reach the optimum temperature and the resistance of the detection element 2 continues to gradually increase. For that reason, in order to maintain an optimum state for detection, there is a need to gradually increase the heating of the detection element 2 so as to optimize the resistance.

Figure 4:
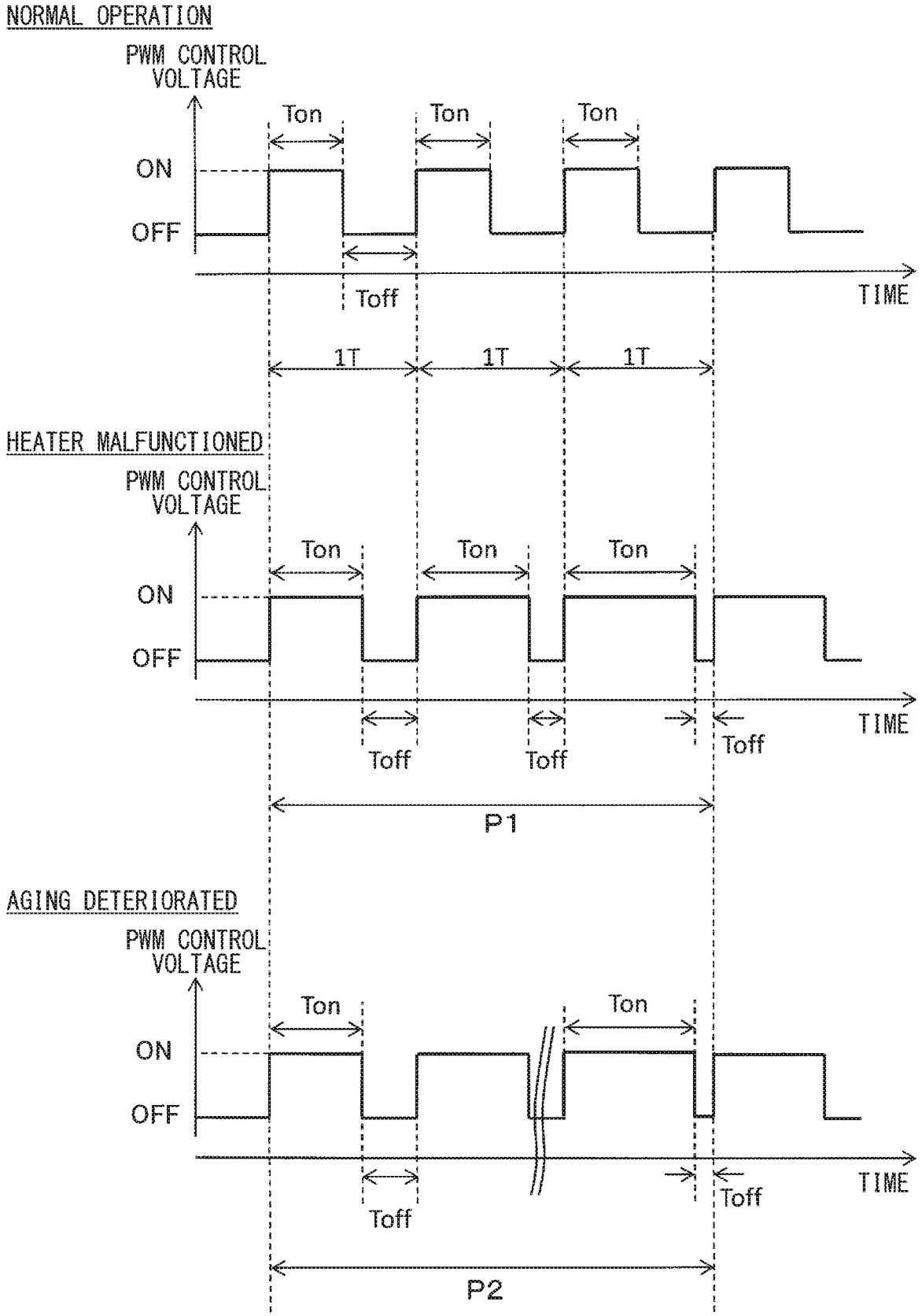
FIG. 4 is a diagram schematically showing a PWM signal when a heater malfunction or a failure of aging deterioration occurs.

For that reason, when the heater 3 malfunctions, the temperature of the heater 3 needs to be gradually increased, and therefore, as shown in FIG. 4, it is considered that the ratio of the ON period (Ton) of the PWM signal in one cycle (1T) becomes larger than the ratio of the ON period (Ton) of the PWM signal at the time of normal operation and continues to increase continuously. For that reason, it is considered that the malfunction of the heater 3 occurs when a manner of increase in which the duty cycle of the PWM signal continuously increases from the duty cycle at the time of normal operation is observed. Incidentally, an increase period (P1) is measured in order to distinguish the failure of the heater 3 from the aging deterioration, as will be described below.

<Aging Deterioration of the Detection Element 2>

It is assumed that the detection element 2 undergoes so-called aging deterioration in which a characteristic of the detection element 2 changes more as a use period becomes longer. The resistance of the detection element 2 of the air-fuel ratio sensor 1 gradually increases as the detection element 2 deteriorates with age. For that reason, in order to maintain an optimum state for detection, there is a need to gradually increase the heating of the detection element 2 so as to optimize the resistance.

For that reason, when the heater 3 malfunctions, the temperature of the heater 3 needs to be gradually increased, and therefore, as shown in FIG. 4, it is considered that the ratio of the ON period (Ton) of the PWM signal in one cycle (1T) becomes larger than the ratio of the ON period (Ton) of the PWM signal at the time of normal operation and continues to increase continuously.

Figure 5:
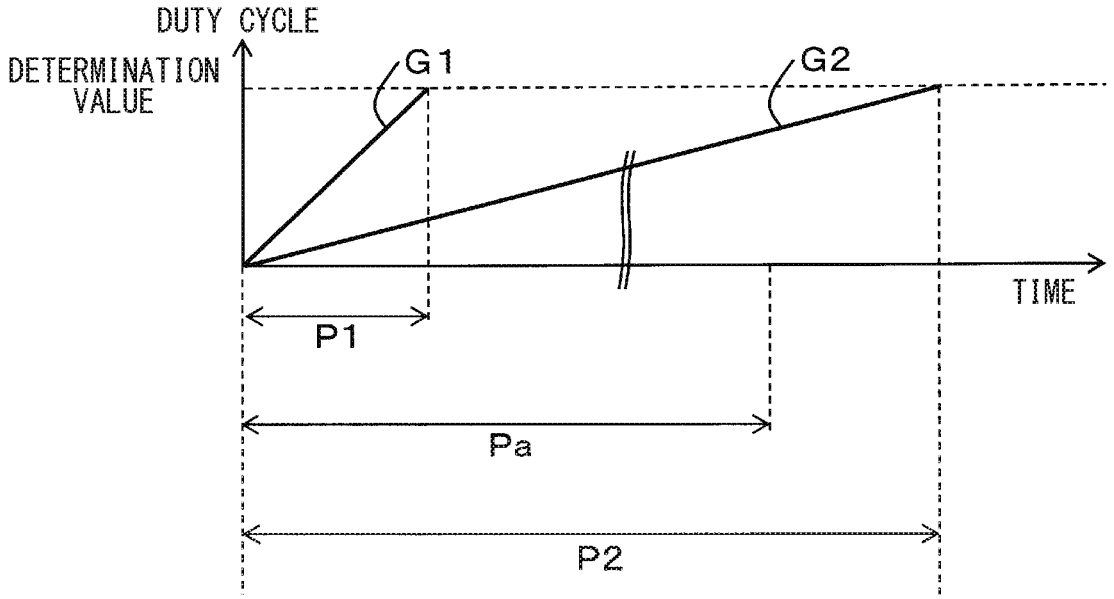
FIG. 5 is a diagram schematically showing a relationship between an increase period and an aging deterioration determination period.

Then, in the case of aging deterioration, as shown as a graph G2 in FIG. 5, an increase period (P2) in which the resistance increases to a predetermined determination value is expected to be longer than the increase period (P1) in the malfunction of the heater 3 shown as a graph G1. For that reason, when the duty cycle of the PWM signal is changed so as to continuously increase from the duty cycle at the time of normal operation and a manner of increase in which the increase period (P2) is longer than a predetermined aging deterioration determination period (Pa) is observed, it is considered that a failure of aging deterioration of the detection element 2 rather than the malfunction of the heater 3 occurs.

As described above, it is considered that various failures that are supposed to occur in the air-fuel ratio sensor 1 cause an increase in the resistance of the detection element 2, that is, a change in the duty cycle. For that reason, when the duty cycle of the PWM signal changes over time, it can be determined that some failure has occurred in the air-fuel ratio sensor 1, and the type of failure can be specified by observing a manner of increase when the duty cycle changes.

Figure 6:
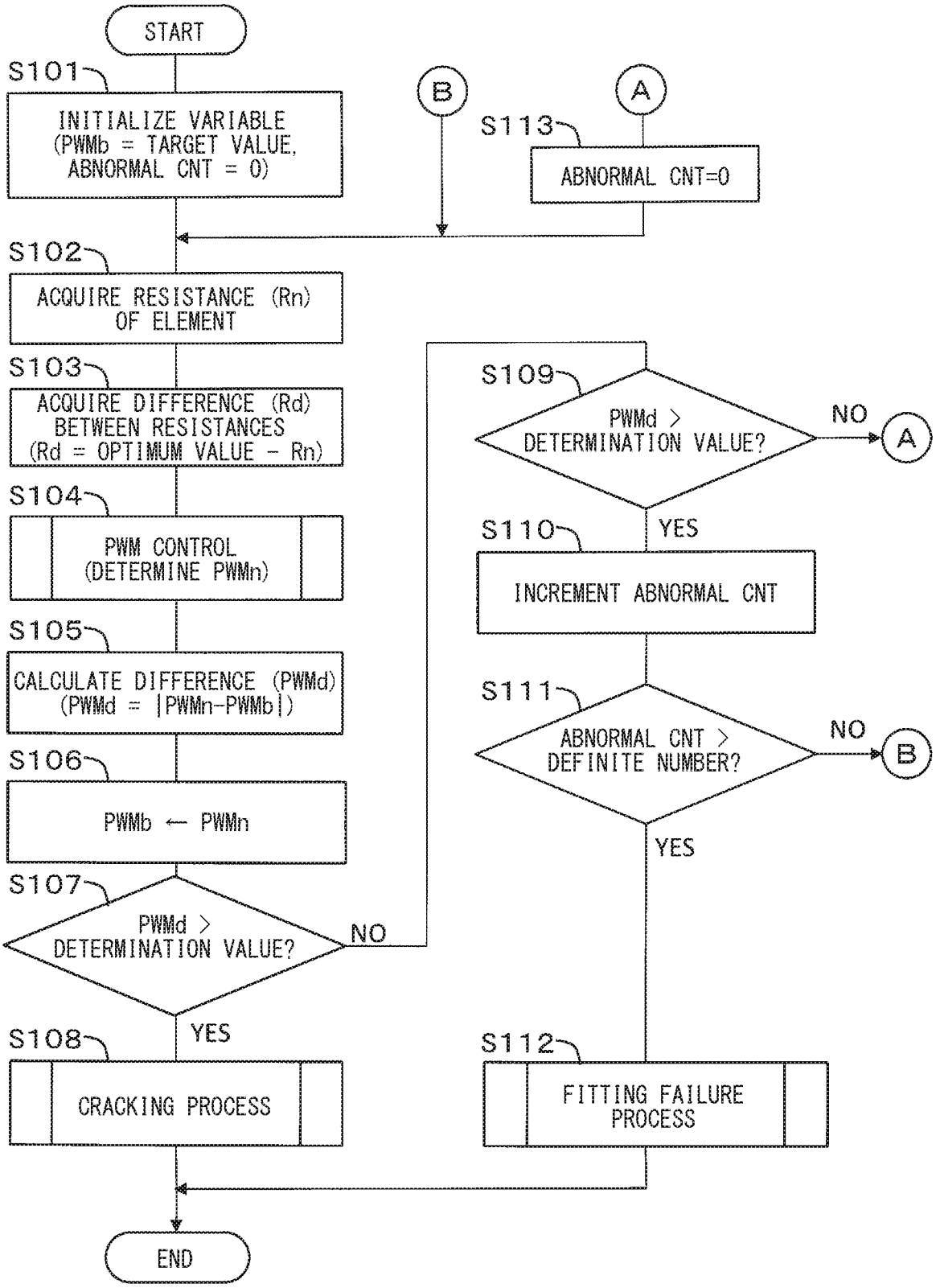
FIG. 6 is a diagram showing a flow of a failure determination process.
Figure 7:
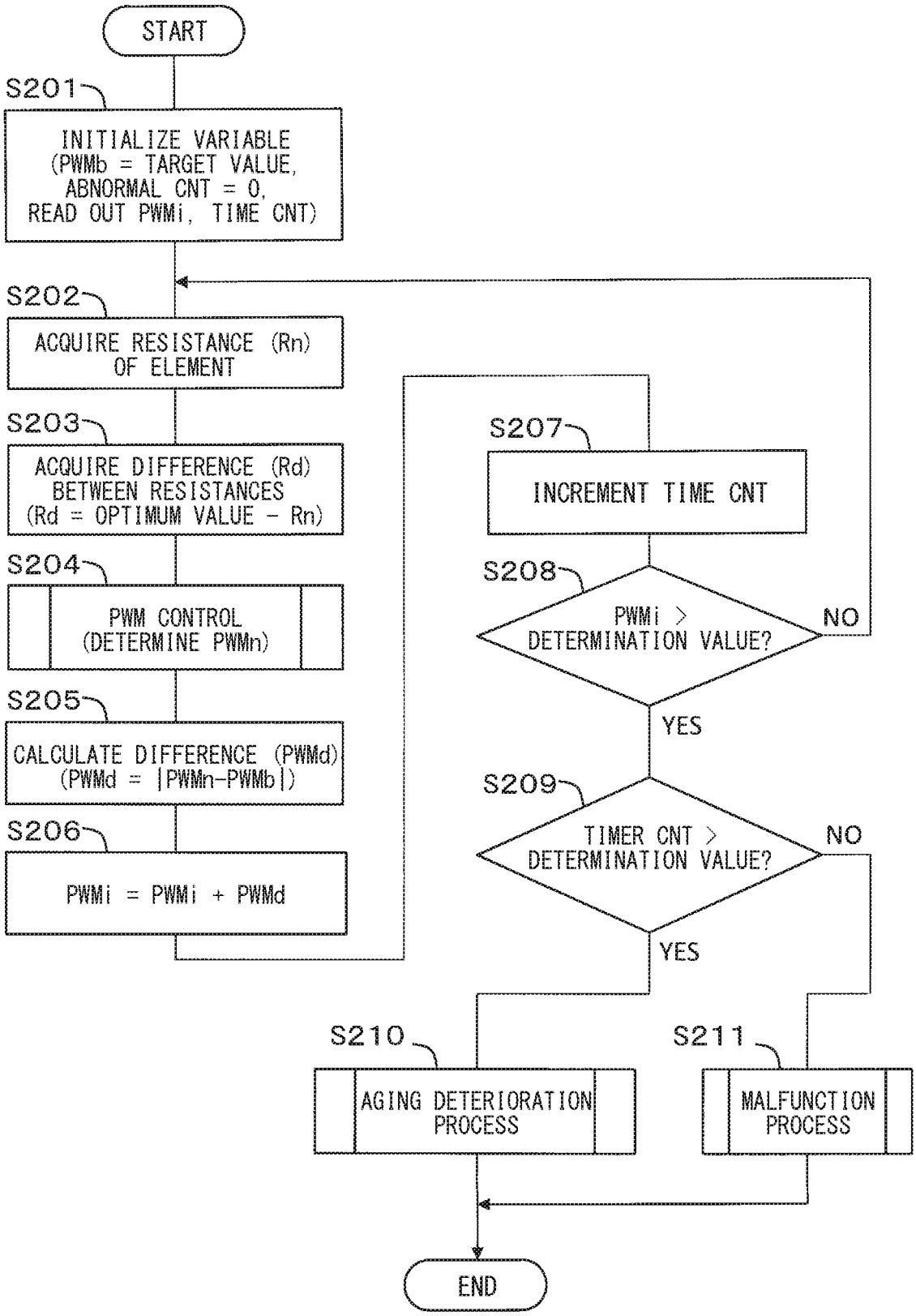
FIG. 7 is a diagram showing the flow of the failure determination process.

For that reason, the controller 10 performs a failure determination process to be described below in addition to the detection process of the oxygen concentration by the air-fuel ratio sensor 1. In the following description, for the sake of simplification of description, a flow of processing for determining the occurrence of crack in the detection element 2 or the fitting failure is shown in FIG. 6, and a flow of processing for determining the malfunction of the heater 3 and the aging deterioration of the detection element 2 is shown in FIG. 7, but those processing can be performed simultaneously or in parallel. The processing shown in FIGS. 6 and 7 is performed by executing a failure detection program in the controller 10.

In a failure determination process shown in FIG. 6, the controller 10 initializes various variables (S101). More specifically, the controller 10 sets the immediately preceding duty cycle (PWMb) to a target value which is a duty cycle at the time of normal operation, and initializes the abnormal CNT for counting the number of abnormalities to 0. The target value may be set based on the specifications and design values of the detection element 2 and the heater 3, or may be set as an actual measurement value at the time of normal operation measured by a shipping test or the like.

When the initialization is completed, the controller 10 acquires a resistance (Rn) of the detection element 2 (S102), and obtains a difference (Rd) of the resistances as Rd=the optimum value−Rn (S102). The optimum value can be set based on the specification of the detection element 2. Then, the controller 10 executes a PWMN control process (S104) for generating a PWM signal for adjusting the temperature of the heater 3 so that the detected current resistance (Rd) becomes an optimum value. At that time, the duty cycle (PWMn) of the present PWM signal is determined.

Subsequently, after the difference (PWMd) of the duty cycle is obtained as PWMd=|PWMn-PWMb| (S105), the controller 10 newly stores the current duty cycle (PWMn) as the immediately preceding duty cycle (PWMb) (S106). Then, the controller 10 determines whether or not the difference (PWMd) of the duty cycles is larger than the crack determination value (S107). The crack determination value is set in advance to determine whether or not the amount of change in the duty cycle exceeds an error range.

When it is determined that the difference (PWMd) of the duty cycles is larger than the crack determination value (YES in S107), the controller 10 determines that a failure of the crack generation has occurred, and executes the crack generation process (S108). In the crack generation process, a countermeasure to be taken when a crack occurs, such as notification of crack generation, is performed.

On the other hand, when it is determined that the difference (PWMd) of the duty cycles is not larger than the crack determination value (NO in S107), the controller 10 determines whether or not the difference is larger than the fitting determination value (S109). The fitting determination value is a value set in advance for determining a fitting failure, and a value larger than the crack determination value is set.

When it is determined that the difference (PWMd) of the duty cycles is not larger than the fitting determination value (S109), the controller 10 sets the abnormal CNTs to 0 (Si 113), and then shifts to Step S102. In other words, the controller 10 determines that the fitting failure has not occurred when the difference (PWMd) of the duty cycles does not exceed the fitting determination value.

On the other hand, when it is determined that the difference (PWMd) of the duty cycles is not larger than the fitting determination value (S109), the controller 10 increments the abnormal CNT (S110) by one, and then determines whether or not the abnormal CNT exceeds a preset abnormality definite number (S111). The abnormality definite number is a value for determining how many times a large change in the duty cycle exceeding the fitting determination value has occurred in succession.

Now, when the controller 10 determines that the abnormal CNT does not exceed the abnormality definite number (NO in S111), the process 10 proceeds to Step S102. In other words, the controller 10 determines that the fitting failure has not occurred at a time point when the change in the duty cycle exceeding the fitting determination value is not continuous in an extent that exceeds the abnormality definite number.

On the other hand, when the controller 10 determines that the abnormal CNT exceeds the abnormality definite number (YES in S111), the controller 10 performs a process against the fitting failure as a result of the occurrence of the fitting failure (S112) because a large change in the duty cycle exceeding the fitting determination value has been continuously observed several times. In the process against the fitting failure, a countermeasure to be taken when the fitting failure occurs, such as notification that the fitting failure has occurred, is performed. In this manner, the controller 10 determines that a crack occurs in the detection element 2 and the fitting failure occurs.

In addition, the controller 10 initializes various variables in the failure determination process shown in FIG. 7 (S201). Specifically, the controller 10 initializes the immediately preceding duty cycle (PWMb) and the abnormal CNT, and reads the accumulated value (PWMi) of the difference (PWMd) of the duty cycles and the time CNT. The accumulated value (PWMi) is set to 0 at the time of first activation, and thereafter, the difference (PWMd) between the duty cycles measured in the operation up to the present time is accumulated and stored in, for example, a nonvolatile memory or the like. The time CNT is a value for counting a period elapsed from the start of accumulation, and is stored in a nonvolatile memory or the like.

When the initialization is completed, the controller 10 acquires the resistance (Rn) of the detection element 2 (S202), obtains the difference (Rd) of the resistances as the optimum value−Rn (S202), executes the PWMN control process (S204), and obtains the difference (PWMd) of the duty cycles as |PWMn−PWMb| (S205), as in FIG. 6 described above.

After the controller 10 has incremented the time CNT (S207), the controller 10 determines whether or not the accumulated value (PWMi) exceeds the malfunction determination value (S208). The malfunction determination value indicates an upper limit of the accumulated value (PWMi). When the accumulated value (PWMi) exceeds the malfunction determination value, it is set to determine that the malfunction is either the malfunction of the heater 3 or the aging deterioration When it is determined that the accumulated value (PWMi) is not larger than the malfunction determination value (NO in S208), the controller 10 shifts to Step S202. In that case, the controller 10 determines that the air-fuel ratio sensor 1 does not malfunction. On the other hand, when the controller 10 determines that the accumulated value (PWMi) is larger than the malfunction determination value (YES in S208), the controller 10 determines whether or not the time CNT is larger than an aging deterioration determination value corresponding to the above-described aging deterioration determination period (Pa) (S209).

When the controller 10 determines that the accumulated value (PWMi) is larger than the aging deterioration determination value (YES in S209), the controller 10 determines that the accumulated value (PWMi) has reached an upper limit when the aging deterioration determination period (Pa) has elapsed, and executes the aging deterioration process (S210). In the aging deterioration process, countermeasures to be taken when aging deterioration occurs, such as notification that aging deterioration has occurred or that a replacement time has come, are performed.

On the other hand, when the controller 10 determines that the accumulated value (PWMi) is not larger than the aging deterioration determination value (NO in S209), that is, when the increase period (P1) is equal to or smaller than the aging deterioration determination period (Pa), since the accumulated value (PWMi) reaches the upper limit in a relatively short period of time, the controller 10 determines that the heater 3 malfunctions, and executes a process against the malfunction of the heater 3 (S211). In the process against the malfunction of the heater 3, countermeasures to be taken when the heater 3 malfunctions, such as notification that the heater 3 has malfunctioned or a replacement time has come, are performed.

According to the controller 10 and the failure detection program described above, the following effects can be obtained.

The controller 10 controls the air-fuel ratio sensor 1 including the detection element 2 for detecting the oxygen concentration, the PWM-controlled heater 3 for adjusting the temperature of the detection element 2 so that the resistance of the detection element 2 becomes a predetermined target resistance. The controller 10 includes the temperature control unit 15 for generating the PWM signal to be given to the heater 3, and the determination unit 17 for determining whether or not a failure has occurred in the air-fuel ratio sensor 1 based on the manner of time-series increase in the duty cycle of the PWM signal.

As described above, it is considered that the failure occurring in the air-fuel ratio sensor 1 affects the PWM signal when the heater 3 is subjected to the PWM control. For that reason, when the duty cycle of the PWM signal changes over time relative to the duty cycle at the time of normal operation, it can be determined that some failure has occurred in the air-fuel ratio sensor 1. In that case, since the generation of the PWM signal is always performed by the controller 10 of the air-fuel ratio sensor 1, a failure can be determined without requiring an additional configuration. Therefore, a failure occurring in the air-fuel ratio sensor 1 can be detected by the controller 10 for the air-fuel ratio sensor 1 alone while maintaining the optimum state for the detection of the oxygen concentration.

When the difference (PWMd) between the immediately preceding duty cycle (PWMb) and the current duty cycle exceeds a predetermined crack determination value, the determination unit 17 of the controller 10 determines that the failure of crack occurrence has occurred in the detection element 2. This makes it possible to identify the failure of the crack occurrence failure among the multiple failures that are supposed to occur in the air-fuel ratio sensor 1.

In addition, the determination unit 17 of the controller 10 determines whether or not the difference (PWMd) between the immediately preceding duty cycle (PWMb) and the current duty cycle (PWMn) exceeds the predetermined fitting failure determination value, and determines that the fitting failure has occurred at the fitting portion 4 of the detection element 2 when the number of times of continuously exceeding the fitting failure determination value exceeds the predetermined abnormality definite number. As a result, the failure of the occurrence of the fitting failure can be identified among the multiple failures that are supposed to occur in the air-fuel ratio sensor 1.

In addition, the determination unit 17 of the controller 10 integrates the difference (PWMd) between the immediately preceding duty cycle (PWMb) and the current duty cycle (PWMn), measures the increase period (P1, P2) required until the integrated value exceeds the preset abnormality determination value, and determines that the failure of the heater 3 has occurred when the increase period (P1, P2) is equal to or less than the preset aging degradation determination period (Pa), while determining that the failure of the aging degradation has occurred when the increase period (P1, P2) is longer than the aging deterioration determination period (Pa). This makes it possible to individually identify the failure of the malfunction of the heater 3 and the failure of the aging deterioration, which exhibit the same manner of increase in the duty cycle, among the multiple failures that are supposed to occur in the air-fuel ratio sensor 1.

In addition, according to the failure detection program for the air-fuel ratio sensor 1, which causes the controller 10 to execute a process of determining whether or not a failure has occurred in the air-fuel ratio sensor 1 based on the manner of time-series increase in the duty cycle of the PWM signal at the time of performing the PWM control, a failure that has occurred in the air-fuel ratio sensor 1 can be detected by the controller 10 alone of the air-fuel ratio sensor 1 while maintaining the optimum state for the detection of the oxygen concentration.

Second Embodiment

Hereinafter, a second embodiment will be described with reference to FIGS. 8 to 12. Since the configurations of an air-fuel ratio sensor 1 and a controller 10 are the same as those of the first embodiment, the configurations will be described with reference to FIG. 1 and the like.

In the present embodiment, the air-fuel ratio sensor 1 is installed in a combustion chamber 21 of a gas water heater 20 as a combustion device. The gas water heater 20 heats a water (W) stored in a tank 24 by supplying a mixture of fuel and air, burning the mixture in the combustion chamber 21 by the burner 22, and heating a heat exchanger 23. In the gas water heater 20 described above, the air-fuel ratio sensor 1 is provided in the combustion chamber 21.

Since the supply of the air-fuel mixture and the combustion of the burner 22 are performed in the combustion chamber 21, convection of heat is periodically generated as indicated by an arrow Y. The periodic convection of heat causes a periodic change in an ambient temperature of a portion where the air-fuel ratio sensor 1 is installed.

Figure 9:
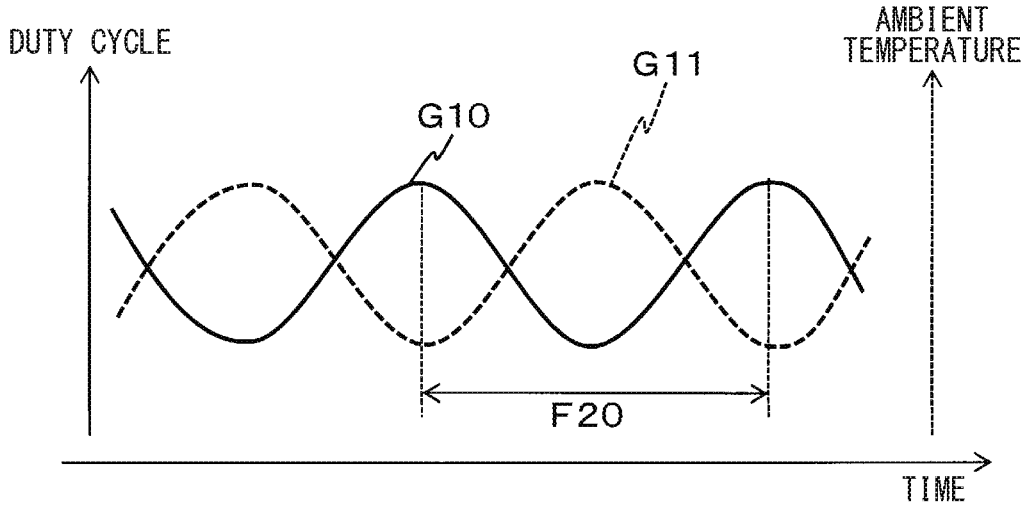
FIG. 9 is a diagram schematically showing an example of a periodic influence of a convection of heat on a duty cycle.

For that reason, when the air-fuel ratio sensor 1 is installed at a position where the convection of heat occurs periodically as described above, a resistance of a detection element 2 of the air-fuel ratio sensor 1 periodically changes depending on the ambient temperature, and as shown in FIG. 9, a duty cycle of a PWM signal shown as a graph G10 becomes relatively small in order to increase the resistance when the ambient temperature shown as a graph G11 rises, while the duty cycle of the PWM signal becomes relatively large in order to decrease the resistance when the ambient temperature falls. Hereinafter, a periodic change of the duty cycle is also referred to as a variation of the duty cycle.

Figure 10:
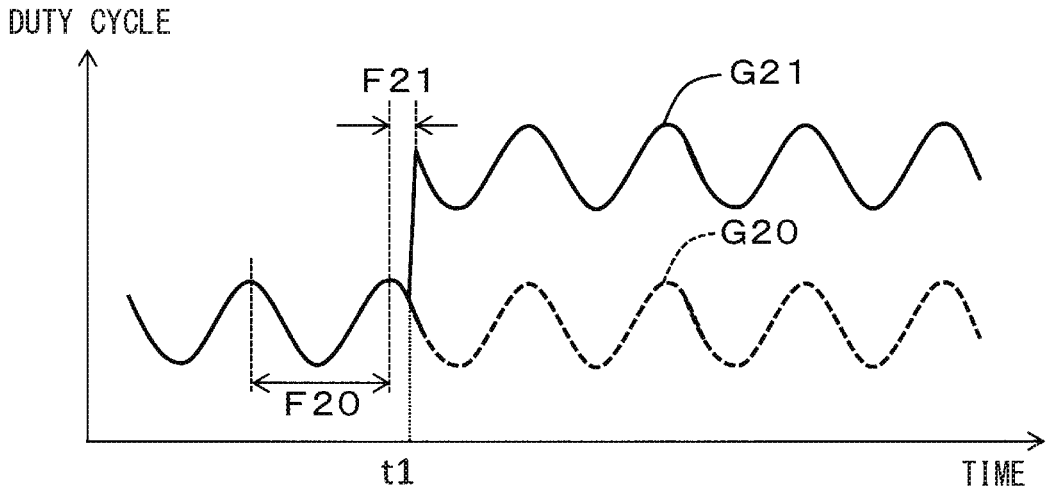
FIG. 10 is a diagram schematically showing an example of a change manner of a cycle when a failure occurs.

In that case, as shown in FIG. 10, it is considered that the occurrence of the failure can be identified by obtaining a cycle (F20) of the duty cycle which changes according to the ambient temperature at the time of normal operation shown as a graph G20 as a period from a maximum value to a minimum value, for example, and comparing a period (F21) at the time of occurrence of the failure shown as a graph G21. In that case, it is considered that the type of the failure can be identified similarly to the first embodiment by determining the subsequent change in the duty cycle in consideration of the periodic variation during the normal operation.

Figure 11:
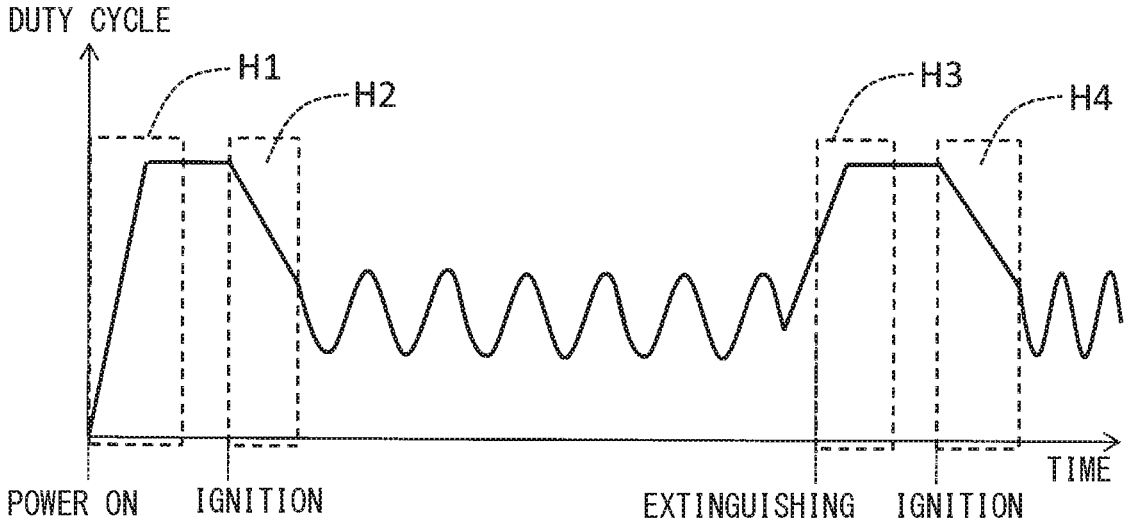
FIG. 11 is a diagram schematically showing an example of an operation state of a combustion device.

Incidentally, in the case of the gas water heater 20, the burner 22 is not ignited at the time of power-on, the ambient temperature rises by the ignition of the burner 22, the periodic change shown in FIG. 9 is observed in a steady combustion state, and the ambient temperature drops when the burner 22 is extinguished. For that reason, as shown in FIG. 11, it is considered that the duty cycle of the PWM signal linearly increases in order to quickly set the resistance of the detection element 2 to the target resistance in a range (H1) close to the time of power-on. An upper limit of the duty cycle is set in consideration of safety and the like, and when the duty cycle is increased to some extent, the duty cycle is kept constant at the upper limit.

Then, in a range (H2) in the vicinity of the ignition of the burner 22, since the temperature of the heater 3 needs to be relatively lowered due to an increase in the ambient temperature, the duty cycle gradually decreases. Although it is considered that a heat flow is generated around the heat flow sensor immediately after ignition of the burner 22, since the resistance of the detection element 2 is greatly changed by an increase in the temperature of the combustion chamber 21, it is considered that the duty cycle following the resistance is substantially linearly decreased.

Thereafter, when the burner 22 becomes in a stable combustion state, the above-mentioned periodic variation in the duty cycle is observed, the duty cycle rises linearly because the ambient temperature drops in a range (H3) in the vicinity where the burner 22 is extinguished, and the duty cycle drops substantially linearly in a range (H4) in the vicinity where the burner 22 is ignited again.

For that reason, in the case of installing the heat flow sensor at a position where the heat convection occurs periodically in the combustion device such as the gas water heater 20, there is a need to determine a failure by taking into consideration a change in the ambient temperature due to the heat convection and an operation state of the combustion device.

Figure 8:
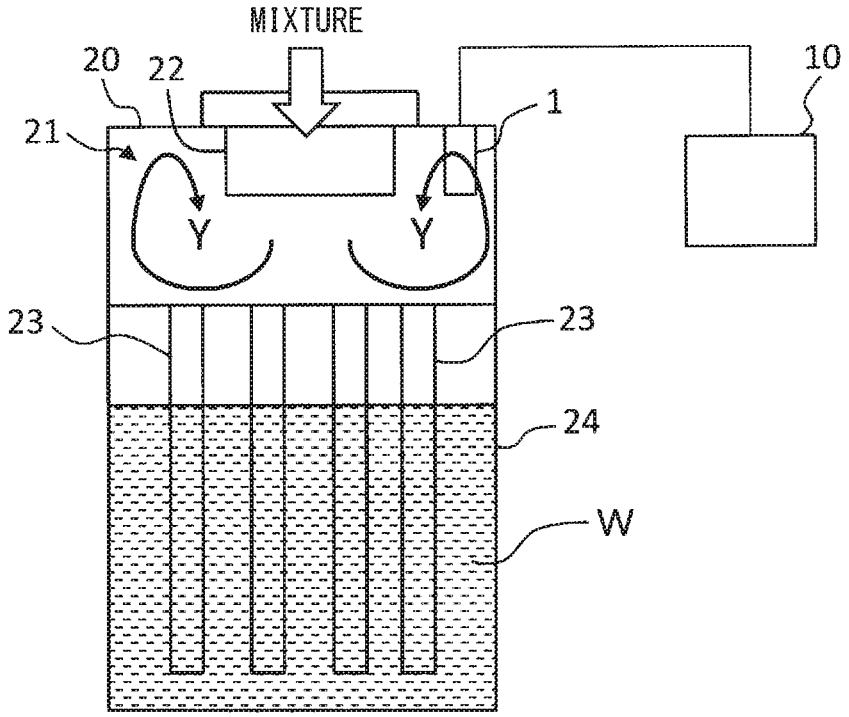
FIG. 8 is a diagram schematically showing an example of a combustion device according to at least one embodiment.
Figure 12:
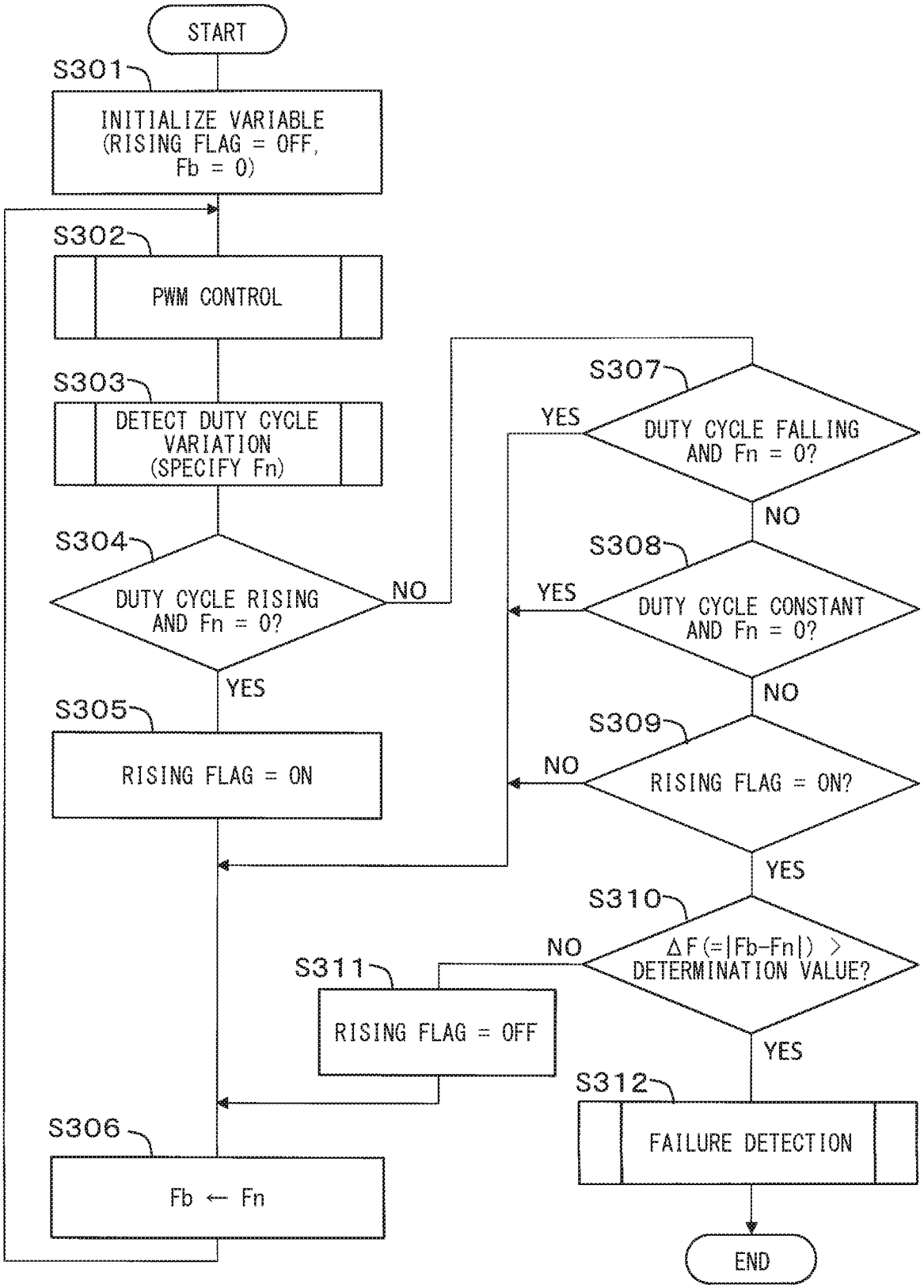
FIG. 12 is a diagram showing a flow of the failure determination process.

For that reason, the controller 10 executes the failure determination process shown in FIG. 12 in consideration of the above situations. The above processing can be performed simultaneously or in parallel with the processing shown in FIGS. 6 and 7. The processing shown in FIG. 8 is performed by executing a failure detection program in the controller 10.

First, the controller 10 initializes variables (S301). In this example, a rising flag indicating a state in which the duty cycle is rising is turned off, and an immediately preceding frequency (Fb) is initialized to 0. When the initialization is completed, the controller 10 performs a PWM control process (S302). Although not shown in FIG. 12, the PWM signal is generated based on the resistance of the detection element 2, similarly to the first embodiment.

Subsequently, the controller 10 executes a process of detecting a variation in the duty cycle (S303). In the processing, a present cycle (Fn) is specified on the basis of the change in the past plural times of the duty cycles acquired over time. Then, it is determined whether or not the duty cycle is increasing and the present frequency (Fn) is 0 (S304). In that case, the controller 10 determines whether or not the duty cycle is substantially linearly distributed, that is, whether or not the duty cycle is linearly rising. Also, during a descent to be described below, the controller 10 determines whether or not the duty cycle is descending linearly.

When the duty cycle is rising and the present frequency (Fn) is 0, that is, when the duty cycle is linearly increasing without observing a periodic variation (YES in S304), the controller 10 determines that the power supply is turned on as in a range (H11) shown in FIG. 11, turns on the rising flag (S305), newly stores the present frequency (Fn) as the immediately preceding frequency (Fb) (S306), and then proceeds to Step S302.

When the duty cycle reaches an upper limit after the above processing has been repeated in a range (H1) after the power has been turned on, the duty cycle stops rising and becomes kept constant. At that time, since the duty cycle is not ascending in Step S304 (NO in S304), the controller 10 determines whether or not the duty cycle is descending and the present frequency (F) is equal to 0 (S307), and since the duty cycle is not decreasing at that point (NO in S307), the controller 10 further determines whether the duty cycle is constant and the present frequency (F) is equal to 0 (S308).

Then, since the duty cycle is kept constant at the present time and the present frequency (F) is equal to 0 (YES in S308), the controller 10 shifts to Step S306 and updates the immediately preceding frequency (Fb), and then repeats the processing of Step S302 and subsequent steps. The iteration is made until the burner 22 is ignited.

Further, when the burner 22 is ignited in a range (H2), the duty cycle is descending in Step S307 and the present frequency (F) is equal to 0 (YES in S307), so that the controller 10 shifts to Step S306 and updates the immediately preceding frequency (Fb), and then repeats the processing of Step S302 and the subsequent processing.

Thereafter, when a certain period of time elapses after the burner 22 is ignited and the inside of the combustion chamber 21 becomes in a stable combustion state, a periodic variation is observed as described above. In that instance, since the duty cycle is rising and the present frequency (F)

is not equal to 0 (NO in S305), the duty cycle is descending, the present frequency (F) is not equal to 0 (NO in S307), the duty cycle is kept constant, and the present frequency (F) is not equal to 0 (NO in S308), the controller 10 determines whether or not the rising flag is on. Since the rising flag is on at the present time (YES in S309), the controller 10 obtains the frequency difference (ΔF) as $\Delta F=|Fb-Fn|$, and determines whether or not the obtained difference (ΔF) exceeds a cycle abnormality determination value (S310). The cycle abnormality determination value is set in advance in order to determine the occurrence of a large frequency deviation shown in FIG. 10, that is, a failure.

Then, the controller 10 turns off the rising flag (S311) when the obtained difference (ΔF) does not exceed the cycle abnormality determination value (NO in S310), although a linear variation is not observed as at an end point of the range (H2), and then proceeds to Step S306. When the rising flag is turned off in this manner, it is found that a period to be excluded from the determination of the failure has ended, that is, the failure should be detected in the next and subsequent processes.

For that reason, in the next and subsequent processes, when the obtained difference (ΔF) exceeds the cycle abnormality determination value (YES in S310), the controller 10 determines that a failure has occurred and executes the failure detection process (S312), and in the failure detection process, the four failures described in the first embodiment or any predetermined failure are detected. When the failure is not detected and reaches, for example, a range (H3), the controller 10 determines whether or not the failure occurs based on whether or not the duty cycle is linearly increased or decreased.

When the failure detection processing is completed, the controller 10 terminates the entire processing because some failure has occurred. However, if the oxygen concentration is still continuously detectable in the failure, the process may proceed to Step S302.

According to the controller 10 and the failure detection program described above, the following effects can be obtained.

The air-fuel ratio sensor 1 is installed at a position where convection of heat occurs periodically, and the determination unit 17 of the controller 10 measures a periodic change in the duty cycle, and when the measured change cycle changes beyond a preset cycle abnormality determination value, it is determined that a failure has occurred in the air-fuel ratio sensor 1. This makes it possible to accurately detect the oxygen concentration even when the ambient temperature of the installation location of the air-fuel ratio sensor 1 periodically changes, for example, as in the case of the gas water heater 20, and also makes it possible to detect a failure occurring in the air-fuel ratio sensor 1 by the controller 10 alone of the air-fuel ratio sensor 1 while maintaining the optimum state for detecting the oxygen concentration.

In addition, the determination unit 17 of the controller 10 measures a change in the periodic duty cycle, and determines that there is no failure even if the duty cycle changes over time, when the duty cycle is rising without a periodic change, when the duty cycle is lowered without a periodic change, and when the duty cycle is kept constant without a periodic change. This makes it possible to determine the occurrence of a failure in a state in which a situation in which the duty cycle is changed but no failure occurs is excluded as in the range (H1) to the range (H4), for example, and makes it possible to reduce the possibility of erroneous determination.

The determination program causing the controller 10 to execute the above processing also makes it possible to accurately detect the oxygen concentration even when the ambient temperature of the installation location of the air-fuel ratio sensor 1 periodically changes, and also makes it possible to detect a failure occurring in the air-fuel ratio sensor 1 by the controller 10 alone of the air-fuel ratio sensor 1 while maintaining the optimum state for detecting the oxygen concentration.

In addition, the configurations shown in the respective embodiments are merely examples, and can be changed or combined as appropriate without any change in the spirit of the present disclosure.

In the first embodiment, an example has been described in which the occurrence of the crack and the fitting failure are determined in one flow, but the determination of the occurrence of the crack and the determination of the fitting failure may be performed as different processing in consideration of the case where the crack determination value is set to be higher than the fitting determination value.

In the second embodiment, the gas water heater 20 is exemplified as the combustion device, but the present disclosure can be applied to other combustion devices as long as the combustion device generates an exhaust gas, such as an internal combustion engine.

In the embodiment, a configuration has been described in which a failure is determined based on a change in the duty cycle. However, since the duty cycle is a ratio of the ON period (Ton) of the PWM signal in one cycle (1T) and the period (1T) of the PWM signal is kept constant, the ON period (Ton) and the OFF period (Toff) can be uniquely obtained if the duty cycle is specified, and conversely, the duty cycle can be obtained if the ON period (Ton) or the OFF period (Toff) is specified. This makes it possible to determine the malfunction of the air-fuel ratio sensor 1 by detecting the change in the ON period (Ton) or the change in the OFF period (Toff) instead of the change in the duty cycle, or by using the calculated values calculated for generating the PWM signals in the PWM control process. In other words, the technical scope of the present application also includes a configuration for determining a failure of the air-fuel ratio sensor 1 based on a change in the ON period (Ton), a change in the OFF period (Toff), and a change in the calculated values, which can substantially specify a change in the duty cycle of the PWM signal.

Although the embodiment exemplifies the configuration in which the failure is determined by the difference between the immediately preceding duty cycle (PWMb) and the frequency (Fb), for example, an average value and a moving average value of the data for the past cycles may be treated as the immediately preceding duty cycle (PWMb) and the frequency (Fb). In other words, the immediately preceding duty cycle (PWMb) and the immediately preceding frequency (Fb) may be data that can be compared with the current duty cycle (PWMn) and the present frequency (Fn) technically or in a common sense manner, and are not necessarily limited to the data acquired immediately before.

Comparative Example

For example, in a combustion device such as a gas water heater, an air-fuel ratio sensor for detecting an oxygen concentration in an exhaust gas is provided in an exhaust path, and a combustion control is performed by detecting the air-fuel ratio from the detected oxygen concentration. The air-fuel ratio sensor is also referred to as an A/F sensor, and includes a detection element including, for example, zirconia, and a heater for adjusting the temperature of the detection element so that the detection element has a predetermined target resistance. When the oxygen concentration is detected, the temperature of the detection element is adjusted by, for example, a PWM (Pulse Width Modulation) controlled heater so that the detection element has an optimum resistance at which the detection element is appropriately activated.

In order to correctly perform a combustion control using the air-fuel ratio sensor described above, there is a need to detect a failure occurring in the air-fuel ratio sensor. For example, a malfunction of the air-fuel ratio sensor may be detected by intentionally shifting the temperature of the heater from an optimum temperature.

However, if the temperature of the detection element is shifted from a temperature at which the optimum resistance is obtained, the detection cannot be performed in an optimum state during the shifted period, and the air-fuel ratio cannot be correctly detected even during the operation of the combustion device. In other words, the temperature of the detection element cannot be maintained at the optimum resistance during the operation of the combustion device. On the other hand, if a detection device for detecting the failure is separately provided and the failure is detected while maintaining the optimum state for detection, an installation space and an attachment structure for the detection device are required.

The present disclosure provides a controller for an air-fuel ratio sensor and a non-transitory storage medium including a failure detection program for an air-fuel ratio sensor, which are capable of detecting a failure occurring in the air-fuel ratio sensor by the controller alone while maintaining an optimum state for detecting an oxygen concentration.

According to a first aspect of the present disclosure, a controller is used for an air-fuel ratio sensor. The air-fuel sensor includes a detection element that detects an oxygen concentration, and a PWM controlled heater that receives a PWM signal to control a resistance of the detection element by adjusting a temperature of the detection element. The controller includes a resistance detection circuit configured to detect the resistance of the detection element, and a processor. The processor is programmed to generate the PWM signal based on the detected resistance such that the resistance of the detection element is kept at a predetermined target resistance, and determine whether a failure has occurred in the air-fuel ratio sensor based on a manner of time-series increase in duty cycle of the PWM signal.

As the failure that is supposed to occur in the air-fuel ratio sensor, cracking of the detection element, that is, a partial breakage such as a crack, a fitting failure of the detection element, that is, a contact failure of the connection portion, a malfunction of the heater, and aging deterioration of the detection element are supposed. Among the above failures, at the time when the crack occurs, it is considered that the resistance of the detection element is greatly increased, as compared with the case where no crack occurs. Further, when the fitting failure occurs, it is expected that the detected resistance will change largely and in a relatively short period of time due to a change in the contact state. Further, when the heater malfunctions, the amount of heat generated decreases even if the same electric power is applied, so that it is expected that the resistance of the detection element increases from an optimum value. Similarly, it is expected that the resistance of the detection element increases from the optimum value when the detection element is deteriorated with age.

In other words, when a failure occurs in the air-fuel ratio sensor, it is considered that the resistance of the detection element or a value detected by the resistance detection unit increases more than in normal operation.

Since the air-fuel ratio sensor can detect the oxygen concentration most accurately when the detection element has the optimum resistance (hereinafter referred to as an optimum value for convenience) it is necessary to make the resistance of the detection element close to the optimum value when the resistance of the detection element increases from the optimum value. In the case of an air-fuel ratio sensor in which the detection element is heated by the heater, there is a need to raise the temperature of the detection element by the heater in order to lower the resistance of the detection element.

For that reason, when a failure occurs and the detection element deviates from an appropriate resistance, the duty cycle of the PWM signal, in this example, an ON period in one cycle of the PWM signal is increased in the case of the PWM-controlled heater. In other words, when the PWM signal changes in a manner in which the duty cycle increases, it can be determined that there is a possibility that some failure has occurred.

For that reason, the controller determines whether or not a failure has occurred in the air-fuel ratio sensor based on the fact that the duty cycle of the PWM signal has increased as compared with the normal operation, that is, based on the manner of time-series increase in the duty cycle of the PWM signal. This makes it possible to determine that some failure has occurred in the air-fuel ratio sensor.

Further, since the resistance of the detection element is originally detected in the air-fuel ratio sensor and the duty cycle is originally calculated for PWM control, the above determination can be performed without providing a separate device. Further, since the output PWM signal is output in order to optimize the current resistance of the detection element, the detection state of the oxygen concentration can be maintained at an optimum level even when it is determined that a failure occurs.

Therefore, a failure occurring in the air-fuel ratio sensor can be detected by the controller for the air-fuel ratio sensor alone while maintaining the optimum state for the detection of the oxygen concentration.

Further, according to a seventh aspect of the present disclosure, a non-transitory storage medium stores a failure detection program for an air-fuel ratio sensor to execute determining whether a failure has occurred in the air-fuel ratio sensor based on a manner of time-series increase in the duty cycle of the PWM signal generated to be given to the heater based on the resistance of the detection element. Similarly to the above first aspect, a failure that has occurred in the air-fuel ratio sensor can be detected by the controller for the air-fuel ratio sensor alone while maintaining the optimum state for the detection of the oxygen concentration.

According to a second aspect of the present disclosure, the processor may determine that cracking has occurred as the failure in the detection element when a difference between an immediately preceding duty cycle and a current duty cycle exceeds a predetermined crack determination value.

Since the detection element for the air-fuel ratio sensor is formed as a solid electrolyte element containing zirconia in many cases, and is used at a relatively high temperature, and is provided in an exhaust path of a combustion device, there is a possibility that a crack occurs when water generated during combustion adheres to the detection element. When a crack occurs in the detection element, as described above, a resistance of the detection element greatly increases as compared with a resistance at the time of normal operation in which no crack occurs, so that there is need to heat the detection element to lower the resistance.

In other words, when such a large increase in the duty cycle of the PWM signal that exceeds a predetermined crack determination value in a short period of time, for example, with respect to the immediately preceding duty cycle, is observed, it can be considered that a crack has occurred in the detection element. For that reason, when the duty cycle exceeds the crack determination value and changes in a short period of time, it can be determined that a crack has occurred.

According to a third aspect of the present disclosure, the processor may determine whether a difference between an immediately preceding duty cycle and a current duty cycle exceeds a predetermined fitting failure determination value. The processor may determine that a fitting failure has occurred as the failure at a fitting portion of the detection element when a number of consecutive times of the difference exceeding the fitting failure determination value becomes larger than a predetermined abnormality definite number.

The detection element is physically attached to the sensor body through the fitting portion. For that reason, when the fitting portion is damaged, it is considered that a phenomenon such as a so-called poor contact occurs in which the contact state changes due to vibration or the like. In that case, since the resistance detected by the resistance detection unit changes in accordance with the contact state, it is considered that the value largely fluctuates in a relatively short period of time when observed over time.

In other words, it is considered that a failure of occurrence of the fitting failure occurs when a state in which the duty cycle of the PWM signal increases or decreases relative to the immediately preceding duty cycle is observed in a relatively short period of time. For that reason, when the number of consecutive times the duty cycle continuously exceeds the fitting failure determination value exceeds the predetermined abnormality definite number, it can be determined that the fitting failure has occurred.

According to a fourth aspect of the present disclosure, the processor may accumulate a difference between an immediately preceding duty cycle and a current duty cycle, and the processor may measure an increase period of time required for the accumulated value exceeding a preset abnormality determination value. The processor may determine that malfunction of the heater has occurred as the failure when the increase period of time is equal to or shorter than a preset aging deterioration determination period. The processor may determine that a failure of aging has occurred as the failure when the increase period of time is longer than the aging deterioration determination period.

When the heater malfunctions, the temperature of the heater is hardly raised even if the temperature of the heater is attempted to be raised, and even if the heater is controlled by the same PWM signal as in the normal operation, the temperature of the detection element does not become optimum, and the resistance of the detection element gradually increases. On the other hand, it is considered that the characteristics of the detection element change, that is, aging deterioration occurs, as a use period becomes longer, and the resistance gradually increases in this case as well.

For that reason, when the duty cycle of the PWM signal continuously increases from the duty cycle at the time of normal operation and the accumulated value exceeds the abnormality determination value, it can be considered that the malfunction of the heater or a failure of aging deterioration has occurred. When the heater malfunctions, it is considered that the accumulated value reaches the abnormality determination value in a shorter period of time than that of aging deterioration.

In other words, it is possible to distinguish whether the malfunction of the heater or aging deterioration has occurred, based on the fact that the accumulated value has reached the abnormality determination value and the period until the accumulated value reaches the abnormality determination value. For that reason, when the increase period is equal to or less than the preset aging deterioration determination period, it can be determined that a failure that the heater malfunctions occurs, and when the increase period is longer than the aging deterioration determination period, it can be determined that a failure of aging deterioration has occurred.

According to a fifth aspect of the present disclosure, the processor may measure a cycle of change in duty cycle caused by periodic heat convection, and the processor may determine that the failure has occurred in the air-fuel ratio sensor when the measured cycle has changed beyond a preset cycle abnormality determination value.

For example, in the combustion chamber of the gas water heater, convection of heat is periodically generated due to supply of the air-fuel mixture and combustion of a burner. The periodic convection of heat causes a periodic change in the ambient temperature of a portion where the air-fuel ratio sensor is installed, thereby causing a change in the temperature of the detection element, that is, a change in the resistance.

For that reason, when the air-fuel ratio sensor is installed at a position where convection of heat occurs periodically, there is a need to consider not only a manner of increase in the duty cycle but also a periodic variation caused by a change in the ambient temperature. When a failure occurs in the air-fuel ratio sensor, the duty cycle increases as described above, and thus it is considered that a deviation occurs in the cycle of the variation.

For that reason, a periodic change in the duty cycle is measured and whether or not the measured period exceeds a cycle abnormality determination value is determined, thereby being capable of determining that a failure has occurred in the air-fuel ratio sensor. In that case, the type of the failure described above can be specified by observing the manner of increase in the duty cycle after the cycle has changed.

According to a sixth aspect of the present disclosure, the processor may measure a cycle of change in duty cycle, and the processor may determine that a failure has not occurred in the air-fuel ratio sensor when the duty cycle increases in a state in which a periodic change of the duty cycle is not observed, when the duty cycle decreases in a state in which the periodic change of the duty cycle is not observed, or when the duty cycle is kept constant in a state in which the periodic change of the duty cycle is not observed.

In the case of the gas water heater described above, the burner is not ignited at the time of power-on, the ambient temperature rises by ignition of the burner, and the ambient temperature drops when the burner is extinguished. For that reason, at the time of power-on, it is considered that the PWM signal linearly increases in order to quickly bring the resistance of the detection element to a target resistance. In addition, am upper limit of the duty cycle is set in consideration of safety and the like, and when the duty cycle increases to some extent, the duty cycle becomes a constant value thereafter. Then, when the burner is ignited, the ambient temperature rises rapidly, so that it is necessary to lower the temperature of the heater relatively rapidly, and the duty cycle gradually decreases linearly. In other words, when an application to an actual combustion device is considered, there is a need to determine that a failure occurs in consideration of the operation state of the combustion device.

Therefore, a cycle in which the duty cycle changes is measured, and when the duty cycle increases in a state in which a periodic change is not observed, when the duty cycle decreases in a state in which the periodic change is not observed, and when the duty cycle is kept constant in a state in which the periodic change is not observed, it is determined that a failure has not occur, thereby being capable of determining that the failure occurs in a state in which the start of the combustion device or the like is excluded, and being capable of performing a failure detection with higher accuracy.

What is claimed is:

1. A controller for an air-fuel ratio sensor, the air-fuel ratio sensor including a detection element that is made of solid electrolyte and detects an oxygen concentration, and a PWM-controlled heater that receives a PWM signal for temperature control of the detection element, the controller comprising:

a resistance detection circuit configured to detect a resistance of the detection element; and a processor programmed to:

generate the PWM signal for the heater based on the detected resistance such that the resistance of the detection element is kept at a predetermined target resistance; and determine whether a failure has occurred in the air-fuel ratio sensor based on a manner of time-series increase in duty cycle of the PWM signal.

2. The controller according to claim 1, wherein the processor determines that cracking has occurred in the detection element as the failure in the air-fuel ratio sensor when a difference between an immediately preceding duty cycle and a current duty cycle exceeds a predetermined crack determination value.

3. The controller according to claim 1, wherein the processor determines whether a difference between an immediately preceding duty cycle and a current duty cycle exceeds a predetermined fitting failure determination value, and the processor determines that a fitting failure has occurred at a fitting portion of the detection element as the failure in the air-fuel ratio sensor when a number of consecutive times of the difference exceeding the fitting failure determination value becomes larger than a predetermined abnormality definite number.

4. The controller according to claim 1, wherein the processor accumulates a difference between an immediately preceding duty cycle and a current duty cycle, the processor measures an increase period of time required for the accumulated value exceeding a preset abnormality determination value, the processor determines that malfunction of the heater has occurred as the failure in the air-fuel ratio sensor when the increase period of time is equal to or shorter than a preset aging deterioration determination period, and the processor determines that aging deterioration has occurred as the failure in the air-fuel ratio sensor when the increase period of time is longer than the aging deterioration determination period.

5. The controller according to claim 1, wherein the processor measures a cycle of change in duty cycle caused by periodic heat convection, and the processor determines that the failure has occurred in the air-fuel ratio sensor when the measured cycle has changed beyond a preset cycle abnormality determination value.

6. The controller according to claim 1, wherein the processor measures a cycle of change in duty cycle, and the processor determines that the failure has not occurred in the air-fuel ratio sensor when the duty cycle increases in a state in which a periodic change of the duty cycle is not observed, when the duty cycle decreases in a state in which the periodic change of the duty cycle is not observed, or when the duty cycle is kept constant in a state in which the periodic change of the duty cycle is not observed.

7. A non-transitory storage medium storing a failure detection program executable by a controller for an air-fuel ratio sensor, the air-fuel ratio sensor including a detection element that is made of solid electrolyte and detects an oxygen concentration, and a PWM-controlled heater that receives a PWM signal generated based on a resistance of the detection element for temperature control of the detection element such that the resistance of the detection element is kept at a predetermined target resistance, the failure detection program being configured to cause the controller to execute:

determining whether a failure has occurred in the air-fuel ratio sensor based on a manner of time-series increase in duty cycle of the PWM signal.

* * * * *